US009245401B2

(12) United States Patent
Nishino et al.

(10) Patent No.: US 9,245,401 B2
(45) Date of Patent: Jan. 26, 2016

(54) BANKNOTE HANDLING DEVICE

(71) Applicant: HITACHI-OMRON TERMINAL SOLUTIONS, CORP., Tokyo (JP)

(72) Inventors: Akira Nishino, Tokyo (JP); Yukihiro Mabuchi, Tokyo (JP); Takeshi Kanagawa, Tokyo (JP); Riichi Katou, Tokyo (JP)

(73) Assignee: HITACHI-OMRON TERMINAL SOLUTIONS, CORP., Tokyo (JP)

( * ) Notice: Subject to any disclaimer, the term of this patent is extended or adjusted under 35 U.S.C. 154(b) by 0 days.

(21) Appl. No.: 14/408,731

(22) PCT Filed: Feb. 20, 2013

(86) PCT No.: PCT/JP2013/000927
§ 371 (c)(1),
(2) Date: Dec. 17, 2014

(87) PCT Pub. No.: WO2013/190738
PCT Pub. Date: Dec. 27, 2013

(65) Prior Publication Data

US 2015/0161840 A1 Jun. 11, 2015

(30) Foreign Application Priority Data

Jun. 18, 2012 (JP) ..... 2012-136750

(51) Int. Cl.

| | |
|---|---|
| ***G07D 11/00*** | (2006.01) |
| ***B65H 31/24*** | (2006.01) |
| ***B65H 83/02*** | (2006.01) |
| ***G07D 9/00*** | (2006.01) |
| *G07F 7/04* | (2006.01) |
| *G07D 13/00* | (2006.01) |

(52) U.S. Cl.

CPC ..... *G07D 11/0066* (2013.01); *B65H 31/24* (2013.01); *B65H 83/02* (2013.01); *G07D 9/00* (2013.01); *G07D 11/0081* (2013.01); *G07D 13/00* (2013.01); *G07F 7/04* (2013.01)

(58) Field of Classification Search

CPC ..... B65H 2701/1912; G07D 7/00; G07D 7/0033; G07D 13/00; G07D 2211/00; G07F 7/04

USPC ..... 194/206, 207, 302, 350; 209/534; 235/379

See application file for complete search history.

(56) References Cited

U.S. PATENT DOCUMENTS

| | | | | |
|---|---|---|---|---|
| 6,978,926 | B2 | 12/2005 | Kobayashi et al. | |
| 2009/0229947 | A1 * | 9/2009 | Takai et al. | 194/206 |

FOREIGN PATENT DOCUMENTS

| | | | |
|---|---|---|---|
| JP | 2004-145600 | A | 5/2004 |
| JP | 2010-117803 | A | 5/2010 |
| JP | 2010-282535 | A | 12/2010 |
| JP | 2011-107923 | A | 6/2011 |
| JP | 2012-108820 | A | 6/2012 |

* cited by examiner

*Primary Examiner* — Mark Beauchaine
(74) *Attorney, Agent, or Firm* — Volpe and Koenig, P.C.

(57) ABSTRACT

Provided is a technique for improving banknote manageability in a banknote handling device. This banknote handling device is provided with multiple banknote storage compartments where banknotes are stored, and a banknote loading compartment where banknotes are stored that are to be loaded in each of the banknote storage compartments. This banknote handling device is provided with a banknote determination unit which obtains the serial numbers of banknotes in conveyance between the banknote storage compartments and the banknote loading compartment, and a conveyance path which conveys banknotes from the banknote loading compartment to the banknote storage compartments via the banknote determination unit. A main control unit of the banknote handling device controls the conveyance path, and, while loading the banknotes from the banknote loading compartment into each of the banknote storage compartments, performs banknote loading processing in which the serial numbers of the banknotes are obtained from the banknote determination unit.

6 Claims, 14 Drawing Sheets

DEPOSIT TRANSACTION PROCESSING
(WHEN STORING BANKNOTES)

100

DEPOSIT TRANSACTION PROCESSING
(WHEN DEPOSIT IS CANCELLED)

100

BANKNOTE LOADING PROCESSING

100

BANKNOTE HANDLING DEVICE

TECHNICAL FIELD

The present invention relates to a banknote handling device.

BACKGROUND ART

In a financial institution, a banknote handling device is used at the time of transaction involving payment and receipt of money between a customer and a staff (a so-called teller) of the financial institution (for example, JP-A-2004-145600). Here, in case of deposit transaction at the financial institution, it is generally treated that the customer side has the ownership of banknotes until the transaction is established. Therefore, the banknote handling device adopts a structure that even after the reception of the banknotes from the customer in the deposit transaction, the banknotes are stored in a temporary holding unit to keep them returnable until the transaction is established, and after the transaction is established, the banknotes are stored in the storage compartments by denomination. The banknote handling device also has a function to exclude as a reject banknote a banknote having a stain, a shape or the like not satisfying a prescribed standard and not suitable for transaction, from the transaction object in order to perform the banknote transaction smoothly.

SUMMARY OF INVENTION

Technical Problem

Here, it is general that the banknote handling device can be provided with not only the above-described function to mediate between the customer and the teller but also a function to perform teller's preparation processing for transaction. As the preparation processing for transaction by the teller, there are, for example, processing to load the banknotes in advance into the banknote storage compartments within the device to prepare for payment transaction, processing to recover the banknotes accumulated by the deposit transaction, processing to scrutinize the number of banknotes stored in the banknote storage compartments within the device, etc.

The financial institution is demanded to have improved banknote manageability at the time of execution of the above preparation processing for the banknote handling device. Specifically, the banknote handling device is demanded that the number of banknotes and others stored in the device can be grasped surely, and the banknotes within the device are suppressed from being lost, disappeared, damaged or deteriorated. However, there was still room for improvement of banknote manageability in the above preparation processing for the transaction.

The present invention has been achieved to solve the above-described problem and aims to provide technology for improving banknote manageability of the banknote handling device.

Solution to Problem

The present invention has been achieved to solve at least a part of the above-described problem and can be realized as the following forms.

The banknote handling device as one form of the present invention is provided with multiple banknote storage compartments in which banknotes are stored; a banknote loading compartment in which stored are banknotes to be loaded into each of the multiple banknote storage compartments; a banknote determination unit which obtains serial numbers from banknotes in conveyance between the multiple banknote storage compartments and the banknote loading compartment; banknote conveyance paths which connect the banknote loading compartment, the banknote determination unit, and the multiple banknote storage compartments; and a control unit for performing banknote loading processing to make the banknote determination unit obtain the serial numbers of the banknotes while loading the banknotes from the banknote loading compartment to each of the multiple banknote storage compartments by controlling the conveyance path in a first conveying direction from the banknote loading compartment to each of the multiple banknote storage compartments via the banknote determination unit.

Advantageous Effects of Invention

According to the present invention, when the loading processing is performed to load banknotes into the multiple banknote storage compartments in the banknote handling device, the control unit obtains the serial numbers inherent in respective banknotes to be loaded. Therefore, the banknotes loaded in the device can be managed according to the serial numbers, and banknote manageability of the banknote handling device is improved.

The subject, construction, effect, etc. of the invention other than those described above are described properly in the descriptions of the following examples and embodiments.

DESCRIPTION OF EMBODIMENTS

Example

Figure 1:
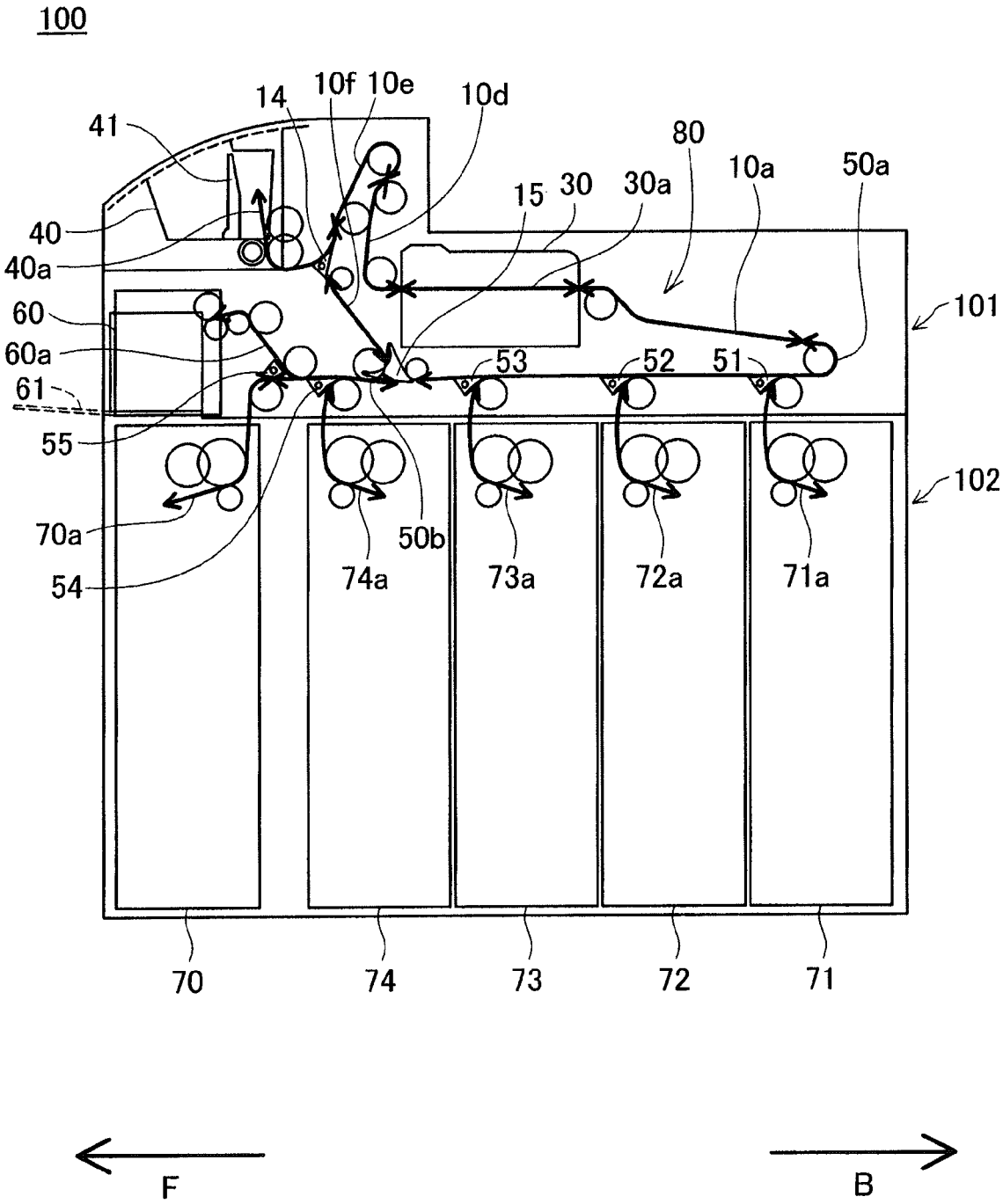
FIG. 1 A schematic view showing the construction of a banknote handling device.

FIG. 1 is a schematic view showing the construction of a banknote handling device as one example of the present invention. This banknote handling device 100 is arranged in a financial institution such as a bank and performs various transaction processing related to payment and receipt of money with a customer in accordance with the operation by a user (a staff of the financial institution such as a so-called teller). And, the banknote handling device 100 performs preparation processing for transaction (described later) before and after various transactions in accordance with the operation by the user.

In this specification, the direction indicated by arrow F that is a side (left side of the sheet) to which the user faces is called "front of the banknote handling device 100." Meanwhile, the direction (a direction opposite to the front) indicated by arrow B that is a side (right side of the sheet) to which the customer faces is called "back of the banknote handling device 100." And, when it is called "right and left direction" in this specification, it indicates the right and left direction when the user faces the front of the banknote handling device 100.

The banknote handling device 100 is provided with a processing mechanism 101 arranged at an upper part, and a housing mechanism 102 arranged at a lower part. The processing mechanism 101 has a banknote depositing/dispensing port 40, a banknote determination unit 30, and a deposit reject compartment 60. The banknote depositing/dispensing port 40 is disposed at a front upper part of the processing mechanism 101, and the user can deposit and take out banknotes, which are subject to transaction, in and from the banknote depositing/dispensing port 40.

The banknote depositing/dispensing port 40 is provided with a shutter 41 which is opened and closed by a rotating mechanism when the user accesses. In the banknote depositing/dispensing port 40, the banknotes deposited by the user are stored in a state that they are set up with the direction along their long sides determined as a horizontal direction. In the banknote depositing/dispensing port 40, the banknotes which are fed from the device in order to provide to the user are also stored in a state that they are set up with the direction along their longer sides determined as a horizontal direction.

The banknote determination unit 30 has therein a conveyance path 30*a* through which banknotes are conveyed in both directions. The conveyance path 30*a* in the banknote determination unit 30 is extended in the longitudinal direction along a horizontal plane, and various kinds of sensors which are omitted from showing in the drawing are arranged to obtain information about banknotes in conveyance. The banknote determination unit 30 performs (i) denomination discrimination and (ii) discrimination whether the banknotes in conveyance correspond to reject banknotes.

Here, in this specification, the "reject banknotes" means banknotes of which stain, shape and discoloration degree do not satisfy a prescribed standard and are not suitable to be used as an object for transaction. Also, the reject banknotes may be determined to be included in the counterfeit banknotes. The banknote determination unit 30 performs discrimination processing of the banknotes by using image data of the banknotes obtained by an optical sensor, a magnetic sensor, etc. and various information such as optical characteristics to ultraviolet rays etc., uneven surface shapes of banknotes, magnetic characteristics, etc.

In addition, about the banknotes in conveyance, the banknote determination unit 30 performs (iii) acquisition of a serial number inherent in banknote. Specifically, the banknote determination unit 30 reads a serial number of the banknote from the image data of the banknote obtained by the optical sensor. The banknote handling device 100 of this example manages the banknotes within the device with reference to the serial numbers of the banknotes, and details are described later. The banknote determination unit 30 outputs the discrimination results and the obtained serial numbers about the banknotes to the control unit (described later).

The deposit reject compartment 60 is an ejection port where the banknotes discriminated as reject banknotes in the banknote determination unit 30 are ejected. The deposit reject compartment 60 is provided at a position in front of the processing mechanism 101 and below the banknote depositing/dispensing port 40. The user can remove a reject banknote included in the banknotes put into the banknote depositing/dispensing port 40 for deposit transaction when the shutter 61 of the deposit reject compartment 60 opens. FIG. 1 shows an open state of the shutter 61 by a broken line.

Here, the processing mechanism 101 is provided with a conveyance path 80 for banknotes to connect the banknote depositing/dispensing port 40, the banknote determination unit 30, and the deposit reject compartment 60 by means of conveyor belts and conveyor rollers. The conveyance path 80 includes conveyance paths 40*a*, 10*e* and 10*d* between the banknote depositing/dispensing port 40 and the banknote determination unit 30, and conveyance paths 10*a*, 50*a*, 50*b* and 60*a* for banknotes arranged between the banknote determination unit 30 and the deposit reject compartment 60. And, the conveyance path 80 of the processing mechanism 101 includes a conveyance path 10*f* which connects the conveyance path 10*e*, which is between the banknote determination unit 30 and the banknote depositing/dispensing port 40, with its end on the side of the banknote depositing/dispensing port 40 to the front end of the conveyance path 50*a*.

The conveyance path 40*a* is connected to a lower end of the banknote depositing/dispensing port 40, and banknotes can be fed in or discharged one by one with respect to the banknote depositing/dispensing port 40 from below. Hereinafter, the conveyance path 40*a* is also called "deposing/dispensing conveyance path 40*a*." The deposing/dispensing conveyance path 40*a* is curvedly extended upward in the direction of gravity from a lower end of the banknote depositing/dispensing port 40 and connected to the conveyance path 10*e*.

The conveyance path 10*e* is obliquely extended upward in the direction of gravity from a position connected with the deposing/dispensing conveyance path 40*a*, returned downward in the direction of gravity and connected to the next conveyance path 10*d*. The conveyance path 10*d* is extended downward in the direction of gravity, bent along the horizontal direction and connected to the conveyance path 30*a* of the banknote determination unit 30. The conveyance path 10*a* is connected to the back end of the conveyance path 30*a* of the banknote determination unit 30. The conveyance path 10*a* is extended to this side of the back end of the banknote handling device 100 and connected to the next conveyance path 50*a*.

Meanwhile, in the banknote handling device 100 of this example, a banknote conveying distance is intentionally made long by the conveyance paths 40*a*, 10*e* and 10*d* which are turned in the vertical direction at the front side of the banknote determination unit 30, and the conveyance path 10*a* which is horizontally extended in the longitudinal direction on the back side of the banknote determination unit 30. This reason is described later.

The conveyance path 50*a* is folded downward in the direction of gravity from the connected part of the conveyance path 10*a* and extended to below the front end of the banknote determination unit 30 below the conveyance path 10*a* and the conveyance path 30*a* of the banknote determination unit 30 and in parallel to the conveyance paths 10*a* and 30*a*. And, first to third banknote storage compartments 71 to 73 of the housing mechanism 102 are arranged below the conveyance path 50*a*.

The conveyance path 50*a* is connected to the conveyance path 50*b* which is horizontally extended in the longitudinal direction and to the conveyance path 10*f* which is extended upward obliquely via a gate 15 for switching a conveyance destination of banknotes. The conveyance path 10*f* is connected to the deposing/dispensing conveyance path 40*a* via a gate 14 for switching a conveyance destination of banknotes.

A fourth banknote storage compartment 74 is arranged below the conveyance path 50*b* which is extended in the horizontal direction, and the conveyance path 50*b* is connected to a connecting conveyance path 74*a* in the fourth banknote storage compartment 74 via a gate 54. And, the conveyance path 50*b* is connected to the conveyance path 60*a* which is connected to the deposit reject compartment 60. Hereinafter, the conveyance path 60*a* is also called the "conveyance path 60*a* for reject compartment."

The conveyance path 60*a* for reject compartment is extended upward obliquely from the conveyance path 50*b* of the former stage and connected to an upper end of the deposit reject compartment 60. The reject banknotes are ejected from above into the reject compartment 60 and stacked therein by the conveyance path 60*a* for reject compartment.

Figure 2:
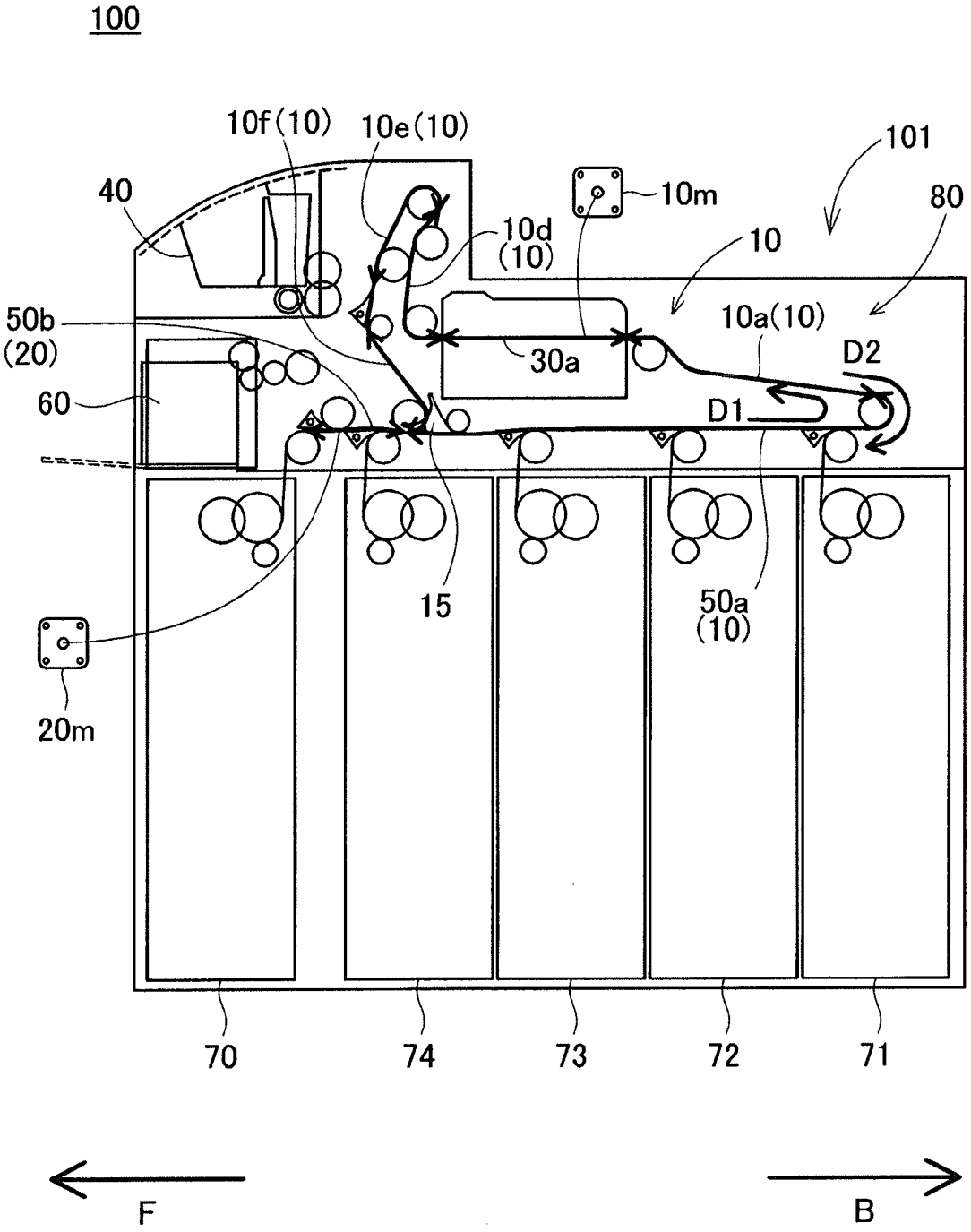
FIG. 2 A schematic view for describing driving forces for conveyance paths of a processing mechanism.

FIG. 2 is a schematic view for explaining the driving force for the conveyance path of the processing mechanism 101. FIG. 2 is almost the same as FIG. 1 excluding the following points. In FIG. 2, the two conveyance paths 40*a* and 60*a*, and connecting conveyance paths 71*a* to 74*a* connecting the processing mechanism 101 and the housing mechanism 102 are omitted from showing in the drawing, and display other than symbols related to the explanation is omitted. And, in FIG. 2, two drive motors 10*m* and 20*m* are schematically shown. For convenience of explanation, the two drive motors 10*m* and 20*m* are extracted from their original positions and shown.

Here, in this specification, in the conveyance path 80 of the processing mechanism 101, the conveyance paths 50*a*, 10*a*, 30*a*, 10*d*, 10*e* and 10*f* which form a loop-shaped route which respectively connects the banknote determination unit 30 and the inlet ports of the first to fourth banknote storage compartments 71 to 74 are also called "first conveyance path 10." And, the conveyance path 50*b* which is connected to the conveyance path 50*a* in the first conveyance path 10 and extended horizontally in the longitudinal direction via the gate 15 is also specially called "second conveyance path 20."

The first conveyance path 10 uses the rotational driving force of the first drive motor 10*m* to convey the banknotes in both directions. Specifically, the first conveyance path 10 can switch the banknote conveying direction by switching the rotation direction of the first drive motor 10*m*, to a first conveying direction D1 (a counter clockwise direction in FIG. 2) and a second conveying direction D2 (a clockwise direction in FIG. 2). The first conveyance path 10 configures a loop-shaped conveyance route as described above. However, in the banknote handling device 100 of this example, banknotes are never conveyed to circulate along the first conveyance path 10 as described later.

Meanwhile, the second conveyance path 20(conveyance path 50*b*) is driven by using the rotational driving force of the second drive motor 20*m*, the conveying direction is switched to the longitudinal direction along a horizontal plane by switching the rotation direction of the second drive motor 20*m*, and banknotes can be conveyed in both directions. Thus, the first and second conveyance paths 10 and 20 are respectively driven by the dedicated drive motors 10*m* and 20*m*, so that their driving directions can be switched independently.

The housing mechanism 102 (FIG. 1) of the banknote handling device 100 is provided with the first to fourth banknote storage compartments 71 to 74 in which banknotes are accumulated by denomination, and the payment reject compartment 70 in which reject banknotes of which ownership belongs to the financial institution side are accumulated. The first to fourth banknote storage compartments 71 to 74 and a payment reject compartment 70 are arranged in a row in this order from the back to the front. The first to fourth banknote storage compartments 71 to 74 and the payment reject compartment 70 are comprised of removable cassettes.

Here, the conveyance paths 50*a* and 50*b* of the processing mechanism 101 are extended horizontally above the first to fourth banknote storage compartments 71 to 74. The first to third banknote storage compartments 71 to 73 are connected to the conveyance path 50*a* through the first to third connecting conveyance paths 71*a* to 73*a*. The fourth banknote storage compartment 74 is connected to the conveyance path 50*b* through the fourth connecting conveyance path 74*a*.

First to fourth gates 51 to 54 for switching a banknote conveyance destination are disposed at positions connecting the first to fourth connecting conveyance paths 71*a* to 74*a* and the conveyance paths 50*a* and 50*b*. And, the first to fourth banknote storage compartments 71 to 74 are provided with a banknote feeding mechanism which can sequentially feed banknotes one by one from the top of the bundle of banknotes which are stacked for storage to the first to fourth connecting conveyance paths 71*a* to 74*a*.

The payment reject compartment 70 is connected to the front end of the conveyance path 50*b* through a connecting conveyance path 70*a*. And, a gate 55 is provided between the connecting conveyance path 70*a* and the conveyance path 50*b*. The gate 55 can switch the connection destination of the conveyance path 50*b* to the conveyance path 60*a* for the reject compartment or to the conveyance path 70*a*. The reject banknotes conveyed in through the connecting conveyance path 70*a* are sequentially stacked within the payment reject compartment 70.

Though omitted from showing in the drawing, detection sensors for detecting the presence or not of banknotes are arranged at prescribed intervals on the conveyance path 80 of the banknote handling device 100. And, detection sensors for detecting the completion of conveying-in/conveying-out of banknotes are arranged in the banknote depositing/dispensing port 40, the deposit reject compartment 60, the payment reject compartment 70 and the banknote storage compartments 71 to 74.

Here, in the banknote handling device 100 of this example, the first to fourth banknote storage compartments 71 to 74 and the payment reject compartment 70 can change their arranged orders and functions arbitrarily, and the banknote handling device 100 can correspond to various use modes accordingly. Details will be described later but the payment reject compartment 70 can be used, for example, as a banknote loading compartment for storing previously banknotes which are loaded into the banknote storage compartments 71 to 74 before the operation of the banknote handling device 100, or as a banknote recovery compartment for storing the banknotes recovered from the banknote storage compartments 71 to 74 after the operation of the banknote handling device 100.

As described above, the banknote handling device 100 has the banknote depositing/dispensing port 40 and the banknote determination unit 30 arranged almost horizontally in the longitudinal direction, and the banknote storage compartments 71 to 74 and the payment reject compartment 70 and the deposit reject compartment 60 are arranged below them in parallel in the longitudinal direction. By this arrangement structure, the banknote handling device 100 of this example has the banknote conveyance route formed between the respective configuration sections simplified (compacted) and shortened, and banknote conveyance efficiency is improved.

Figure 3:
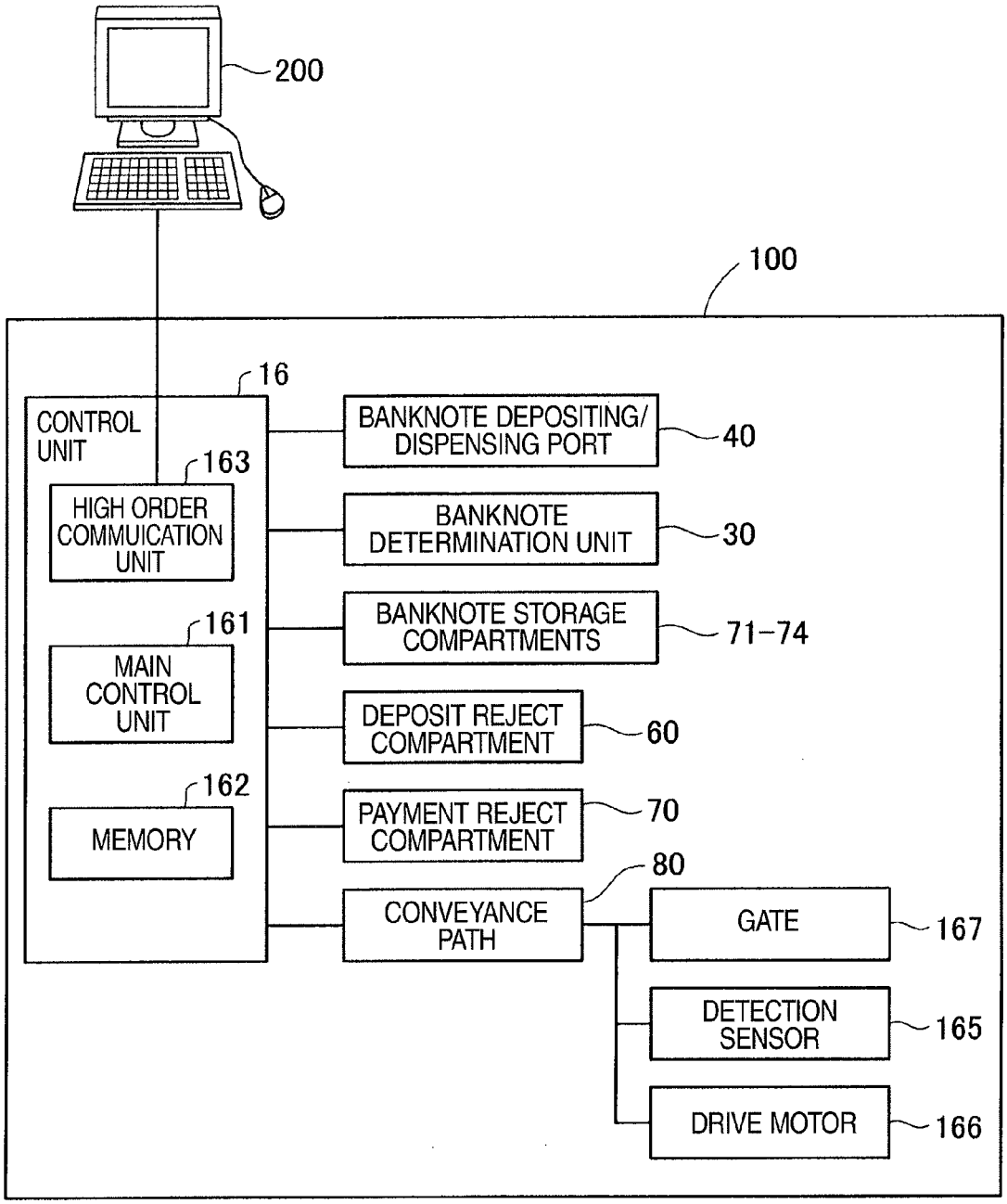
FIG. 3 A block diagram showing a control structure of the banknote handling device.

FIG. 3 is a block view showing a control structure of the banknote handling device 100. The banknote handling device 100 is provided with a control unit 16 for controlling the whole device. The control unit 16 has at least a main control unit 161, a memory 162, and a high order communication unit 163. The main control unit 161 is comprised of a microprocessor for control. Details are described later but the main control unit 161 functions as a processing executing part for making the banknote handling device 100 perform various processing.

The memory 162 is a main storage device in which various data related to the banknotes such as various programs performed by the main control unit 161, and the serial numbers etc. of the banknotes obtained from the banknote determination unit 30 are stored. The high order communication unit 163 controls communications with an operation terminal 200 which is comprised of a personal computer and the like. Information about the banknotes stored in the memory 162 is also transmitted to the operation terminal 200 by the high order communication unit 163.

The control unit 16 controls the banknote determination unit 30, the banknote depositing/dispensing port 40, the deposit reject compartment 60, the payment reject compartment 70, the banknote storage compartments 71 to 74, and the conveyance path 80 by the main control unit 161. The control of the conveyance path 80 by the main control unit 161 is performed by controlling a detection sensor 165, a drive motor 166, and a gate 167.

Here, the detection sensor 165 includes the above-described sensors arranged on the conveyance path 80 and respective configuration sections. And, the gate 167 includes the gates 14, 15, 51, 52, 53, 54 and 55 provided on the conveyance path 80 shown in FIG. 1 and FIG. 2. The drive motor 166 includes the first and second drive motors 10*m* and 20*m* described with reference to FIG. 2.

Figure 4:
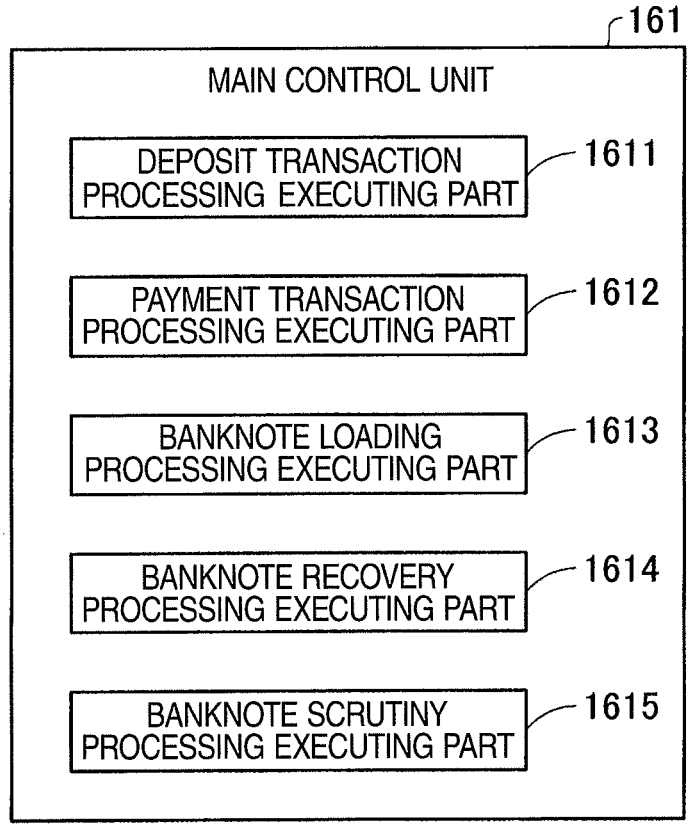
FIG. 4 A block diagram showing the inside structure of a main control unit.

FIG. 4 is a block diagram showing the inside structure of the main control unit 161. The main control unit 161 is provided with functions as a deposit transaction processing executing part 1611 and a payment transaction processing executing part 1612 to perform transaction processing in the banknote handling device 100.

The main control unit 161 is provided with functions as processing executing parts 1613 to 1615 for performing banknote loading processing, banknote recovery processing, banknote scrutiny processing as preparation processing for transaction by the banknote handling device 100. Specifically, the main control unit 161 is provided with functions as the banknote loading processing executing part 1613, the banknote recovery processing executing part 1614, and the banknote scrutiny processing executing part 1615.

Detailed contents of respective transaction processing and respective preparation processing in the banknote handling device 100 of this example are described below. In the following description, the respective processing executing parts 1611 to 1615 which are respective processing execution subjects are not distinguished but explained as the main control unit 161.

Figure 5:
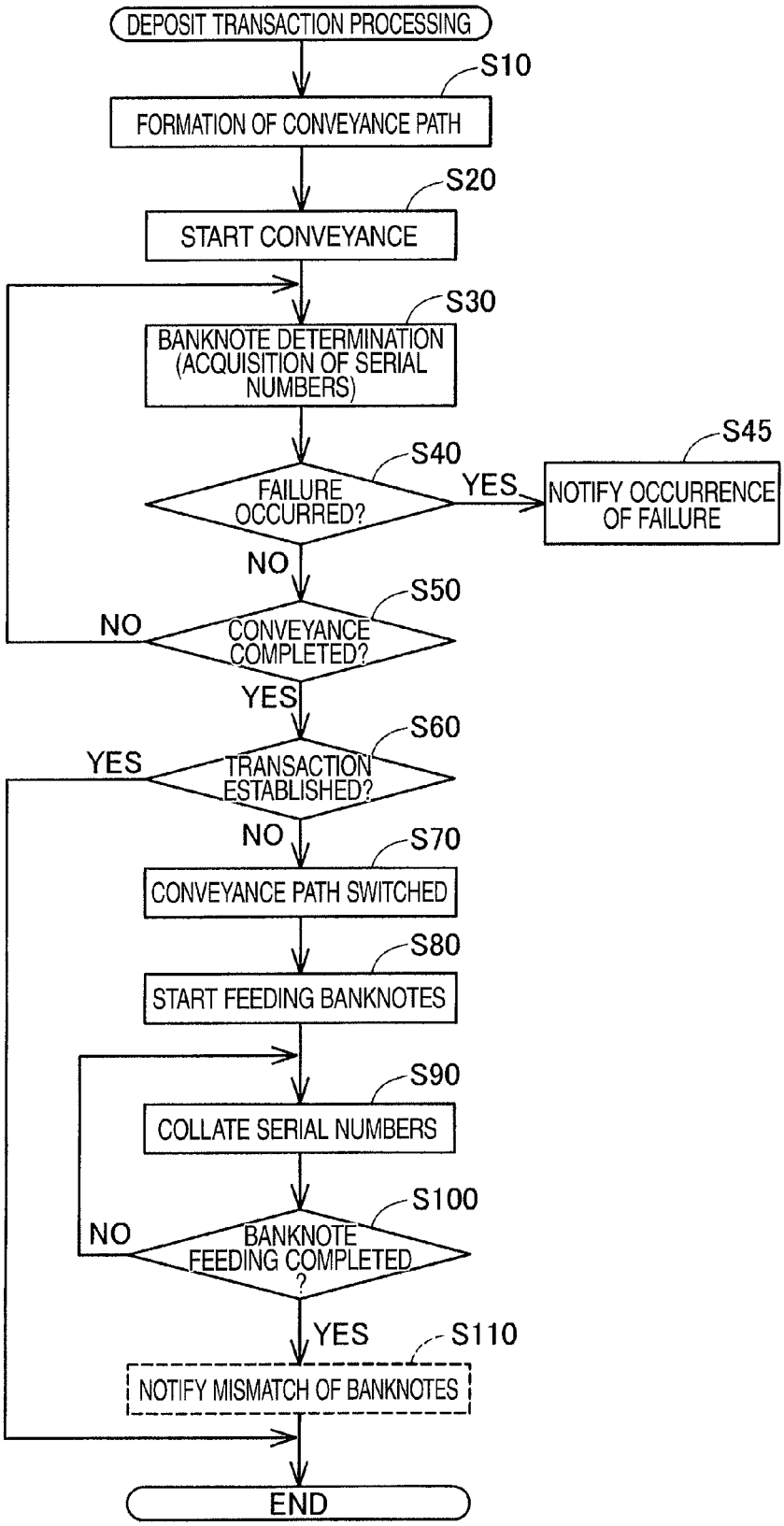
FIG. 5 An explanatory view showing a processing procedure of deposit transaction processing.

[1] Deposit Transaction Processing:

FIG. 5 is a flow chart showing a processing procedure of the deposit transaction processing performed by the banknote handling device 100. Here, the "deposit transaction processing" is processing that stores the banknotes received from the customer in the respective banknote storage compartments 71 to 74 by denomination from the banknote depositing/dispensing port 40.

Meanwhile, in deposit transaction processing, reject banknotes included in the banknotes received from the customer are excluded from the transaction object. And, in deposit transaction processing, even after the banknotes received from the customer are deposited in the banknote handling device 100, the received banknotes are returned as they are to the customer if the transaction is not established (transaction is cancelled).

In step S10, the main control unit 161 constitutes a conveyance route for conveying banknotes from the banknote depositing/dispensing port 40 to the respective banknote storage compartments 71 to 74 or the deposit reject compartment 60 in the processing mechanism 101. Specifically, the main control unit 161 controls the gate 167 and the drive motor 166 (FIG. 3) to constitute the following conveyance route.

Figure 6:
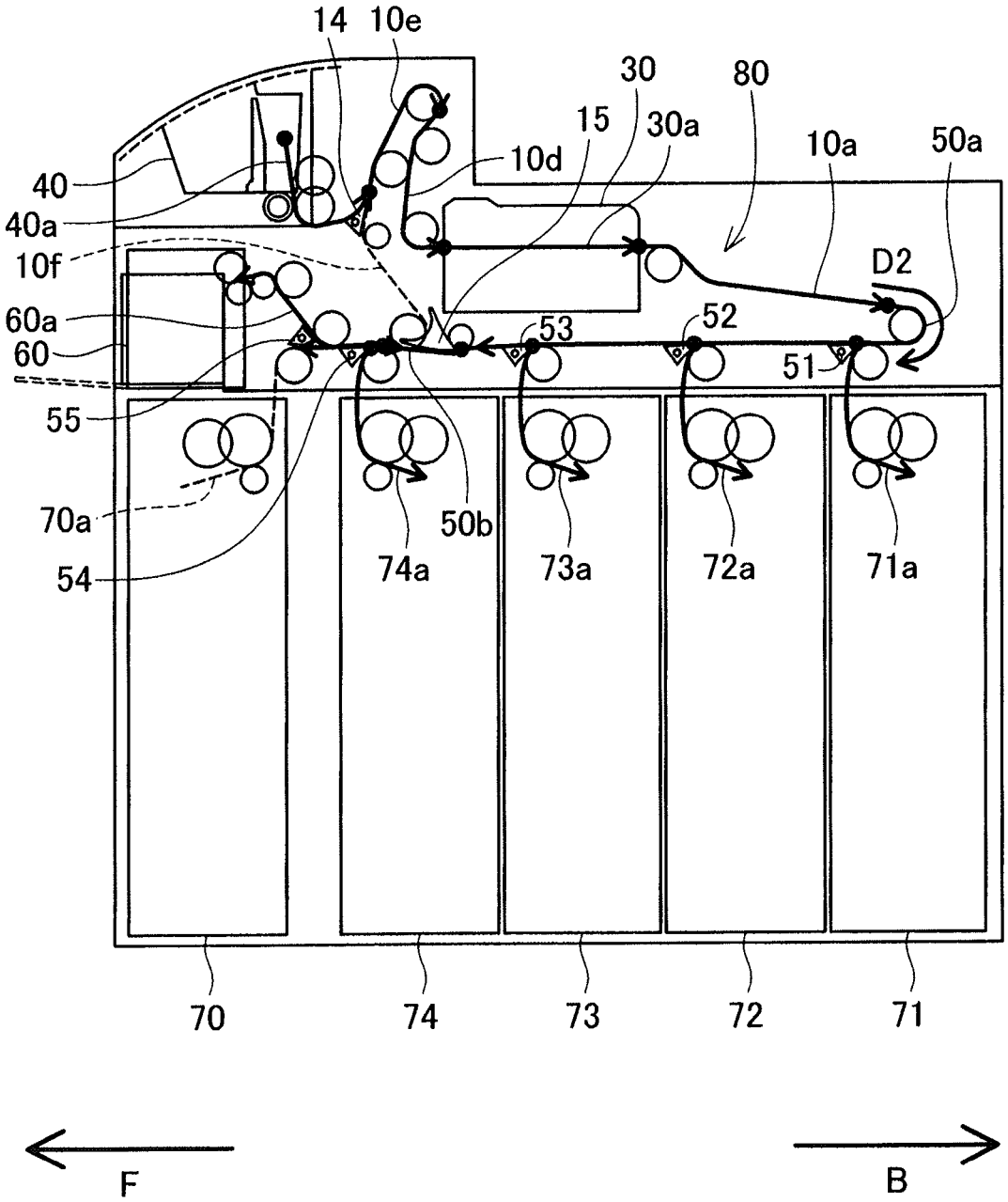
FIG. 6 A schematic view showing banknote conveyance routes for storing banknotes into respective banknote storage compartments or a deposit reject compartment in deposit transaction processing.

FIG. 6 is a schematic view showing banknote conveyance routes for storing the banknotes received from the customer by the deposit transaction processing into the respective banknote storage compartments 71 to 74 or the deposit reject compartment 60. FIG. 6 is almost the same as FIG. 1 excluding the points that the banknote conveying directions are indicated by solid arrows and a conveyance path not used for conveying banknotes is indicated by a broken line.

The main control unit 161 controls the gate 14 to connect the respective conveyance paths 40*a*, 10*e* and 10*d* between the banknote depositing/dispensing port 40 and the banknote determination unit 30. And, the main control unit 161 controls the gate 15 to connect the conveyance path 50*a* and the conveyance path 50*b*, and controls the gate 55 to connect the conveyance path 50*b* and the conveyance path 60*a* for reject compartment.

The main control unit 161 rotates the first drive motor 10*m* to convey the banknotes in a direction of arrow D2 in the first conveyance path 10 (FIG. 2). And, the main control unit 161 rotates the second drive motor 20*m* to convey banknotes from the back to the front in the conveyance path 50*b* which is the second conveyance path 20.

The main control unit 161 starts conveying the banknotes when it is confirmed that the bundle of banknotes received from the customer was deposited in the banknote depositing/dispensing port 40 by a user (step S20 in FIG. 5). The main control unit 161 causes to feed banknotes one by one from the banknote depositing/dispensing port 40 by the deposing/dispensing conveyance path 40*a* and causes to convey to the banknote determination unit 30 through the conveyance paths 10*e* and 10*d*.

The main control unit 161 causes the banknote determination unit 30 perform denomination discrimination, reading of serial numbers, detection of reject banknotes about respective banknotes (banknotes in conveyance) being conveyed (step S30). At this time, the main control unit 161 stores information about the obtained banknotes into the memory 162 and also transmits to the operation terminal 200 appropriately.

The banknotes having passed through the banknote determination unit 30 are conveyed to the conveyance path 50*a* through the conveyance path 10*a*. The main control unit 161 controls the gates 51 to 54 according to denomination discriminated by the banknote determination unit 30 to convey the banknotes which are in the conveyance path 50*a* into the banknote storage compartments 71 to 74 for corresponding denominations. And, the main control unit 161 allows the reject banknotes pass through the conveyance path 50*a*, and conveys into the deposit reject compartment 60 through the conveyance paths 50*b* and 60*a*.

By the way, the banknote handling device 100 of this example completes denomination discrimination of the banknotes and determination of the reject banknotes while the banknotes are passing through the conveyance path 10*a* between the banknote determination unit 30 and the first banknote storage compartment 71. That is, after the banknotes have passed through the banknote determination unit 30, and before they reach the gate 51 of the first banknote storage compartment 71, a conveyance destination of the banknotes is determined.

Therefore, the banknotes can be stored smoothly into the respective banknote storage compartments 71 to 74 without stopping the banknote conveyance. Thus, at the time of deposit transaction in the banknote handling device 100 of this example, the conveyance path 10*a*, which is a latter stage of the banknote determination unit 30, functions as a path for securing a processing time for discrimination of banknotes in the banknote determination unit 30.

The main control unit 161 repeats the above-described banknote conveyance processing until the conveyance of all banknotes deposited in the banknote depositing/dispensing port 40 is completed (step S50). If a failure such as a conveyance jam is detected by a detection sensor while the above-described banknote conveyance processing is being performed (step S40), the main control unit 161 notifies the occurrence of the failure to the user via a display part of the operation terminal 200 (step S45).

Figure 7:
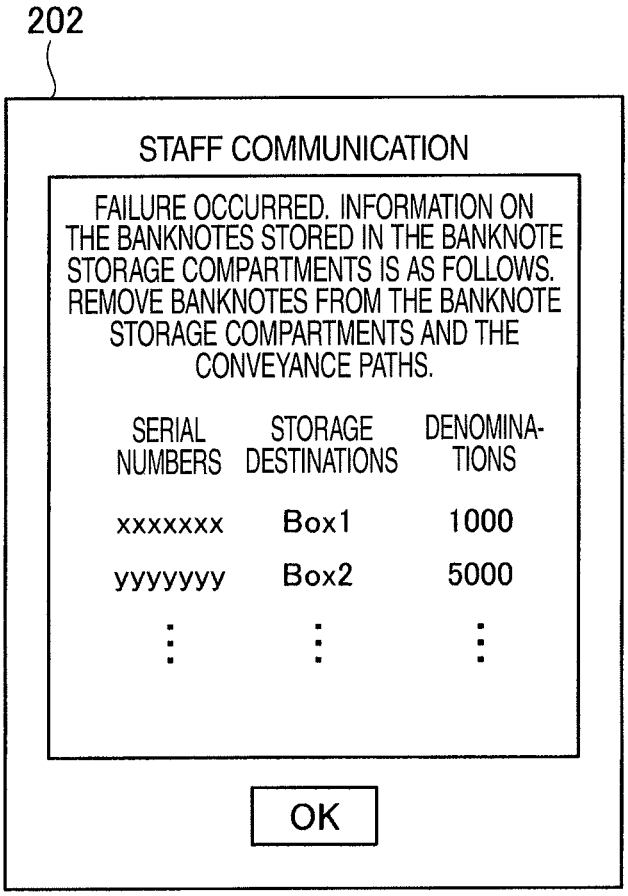
FIG. 7 A schematic view showing a display example of a message for notifying failure occurrence.

FIG. 7 is a schematic view showing an example of showing a message notifying a failure occurrence. Here, the memory 162 and the operation terminal 200 record therein the denominations, serial numbers and storage destinations (the first to fourth banknote storage compartments 71 to 74 or the reject compartment 60) of the banknotes received from the customer in correspondence with one another according to the information about the banknotes obtained from the main control unit 161.

Therefore, if a failure occurs during the conveyance of banknotes involved in the deposit transaction, the occurrence of the failure is notified, and information (serial numbers, storage destination, denomination, etc.) about the banknotes of which conveyance has completed before the occurrence of the failure is displayed as staff communication 202 to the user. According to the display information of the staff communication 202, the user can remove banknotes having the same serial numbers as the deposited banknotes from the banknote handling device 100.

After the conveyance of all banknotes deposited in the banknote depositing/dispensing port 40 is completed without problems, the user shows the customer the amount of banknotes accounted and received by the banknote determination unit 30 to confirm again whether the customer intends to deposit (step S60 in FIG. 5). When the customer shows an intention to deposit, it is determined that the transaction was established, and the ownership of the banknotes is switched from the customer to the financial institution.

Incidentally, the banknote handling device 100 may have an operation portion for expression of intention such as decision or cancel of the deposit transaction provided on the upper surface of the user side (front side of the banknote handling device 100) so that the user can operate it. Otherwise, the operation portion may be provided on the upper surface of the customer side (on the back side of the banknote handling device 100) so that the customer can operate it.

In the banknote handling device 100, the deposit transaction processing is terminated when the deposit transaction is finally decided by the customer (arrow YES in step S60). On the other hand, if the customer cancels the deposit transaction (arrow NO in step S60), the banknotes received from the customer are returned to the customer as they are in step S70 and subsequent processing. In step S70, the main control unit 161 switches the structure of the conveyance path 80 to configure a conveyance route for paying back.

Figure 8:
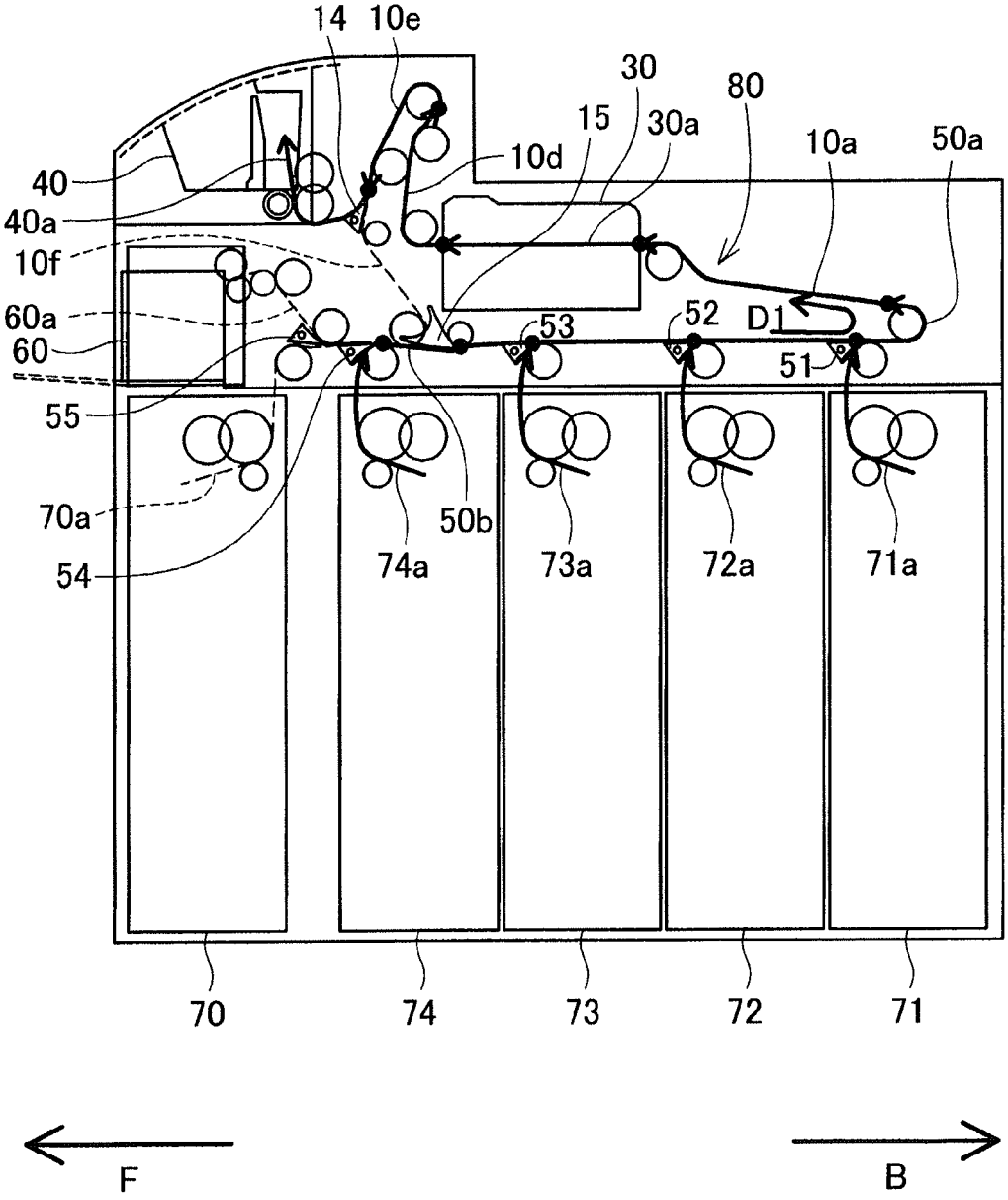
FIG. 8 A schematic view showing banknote conveyance routes for returning customer banknotes from the banknote storage compartments to a banknote depositing/dispensing port in deposit transaction processing.

FIG. 8 is a schematic view showing banknote conveyance routes for returning the banknotes of the customer stored in each of the first to fourth banknote storage compartments 71 to 74 in deposit transaction processing to the banknote depositing/dispensing port 40. FIG. 8 is almost the same as FIG. 6 excluding the point that the banknote conveyance route shown in the drawing is different.

The main control unit 161 switches the rotation directions of the first and second drive motors 10*m* and 20*m* to directions opposite to those in the banknote storing processing described with reference to FIG. 6. Thus, the banknotes can be conveyed from the respective banknote storage compartments 71 to 74 to the banknote depositing/dispensing port 40 via the banknote determination unit 30. In step S80 (FIG. 5), the main control unit 161 controls the conveyance paths 71*a* to 74*a* to feed banknotes one by one from any of the respective banknote storage compartments 71 to 74.

Here, the main control unit 161 reads data of serial numbers and storage destinations of banknotes (hereinafter also called simply "record data") which were obtained by the banknote determination unit 30 in step S30 and stored in the memory 162 or the operation terminal 200. And, based on a storage destination of banknotes recorded in the record data, the banknotes are fed from the respective banknote storage compartments 71 to 74. Hereinafter, the banknotes fed from the respective banknote storage compartments 71 to 74 are also called "return banknotes."

The return banknotes fed from the first to third banknote storage compartments 71 to 73 reach the banknote determination unit 30 through the conveyance paths 50*a* and 10*a*. The return banknotes fed from the fourth banknote storage compartment 74 reach the banknote determination unit 30 through the conveyance paths 50*b*, 50*a* and 10*a*. The banknote determination unit 30 reads the serial numbers of return banknotes and collates with record data obtained from the memory 162 or the operation terminal 200 (step S90).

The main control unit 161 conveys continuously to return the banknotes while checking that the serial numbers of return banknotes are present in the data recorded in step S30 (step S100). In collation processing of the serial numbers in step S90, if a mismatch of serial numbers of the record data of the operation terminal 200 and the serial numbers of return banknotes is not detected, the user returns the return banknotes accumulated in the banknote depositing/dispensing port 40 to the customer as they are.

On the other hand, if a mismatch is detected between the serial numbers of record data and the serial numbers of the return banknotes in the collation processing of the serial numbers in step S90, the main control unit 161 shows that effect on the display part of the operation terminal 200 to notify the user (step S110). Meanwhile, the case that a mismatch of serial numbers occurs includes, for example, a case that the return banknotes are short, a case that banknotes having serial numbers which are not contained in the record data are mingled in the return banknotes, etc.

Figure 9:
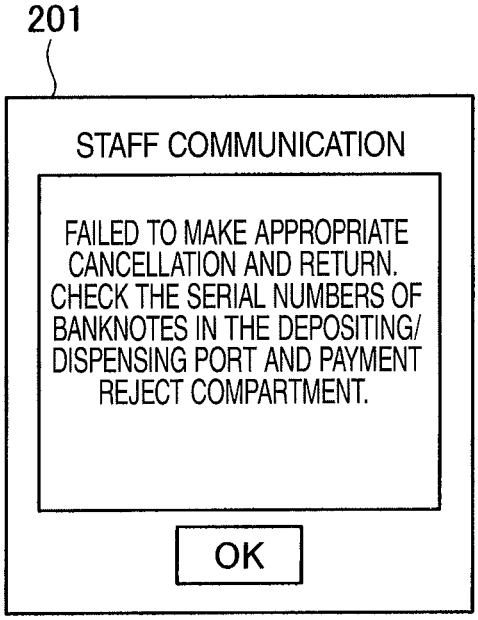
FIG. 9 A schematic view showing a display example of a message to be notified to a user when a mismatch of serial numbers is detected.

FIG. 9 is a schematic view showing a display example of a message notified to the user in step S110. When this staff notification 201 is displayed, the user checks the serial numbers of banknotes in the banknote depositing/dispensing port 40 or the deposit reject compartment 60 or examines the banknotes in the first to fourth banknote storage compartments 71 to 74, and performs a work to match the banknotes received from the customer and the return banknotes.

Thus, the banknote handling device 100 of this example stores the banknotes received from the customer with their serial numbers and storage destination recorded. Therefore, when the deposit is cancelled, the banknotes having the same serial numbers can be returned to the customer based on their serial numbers, thereby securing banknote manageability.

By the way, a conventional banknote handling device keeps the banknotes received from the customer in a temporary holding unit so that they can be returned as they are until the deposit transaction is established by the customer, and if the deposit was cancelled, the banknotes were returned from the temporary holding unit. However, the banknote handling device 100 of this example can omit the temporary banknote holding unit because the banknotes temporarily received from the customer can be returned securely by virtue of the above-described structure.

Therefore, the banknote handling device 100 of this example can shorten the conveyance route for storing the banknotes to the extent of the omission of the route for passing through the temporary holding unit, and the deposit transaction processing can be performed quickly and efficiently. And, handling properties and protection properties of banknotes are improved and their manageability is improved because a fatigue, a damage or a loss of banknotes due to conveyance are suppressed by shortening and simplifying the banknote conveyance route. Furthermore, the temporary holding unit is omitted, and the conveyance route is shortened and simplified, so that the device can be miniaturized.

Figure 10:
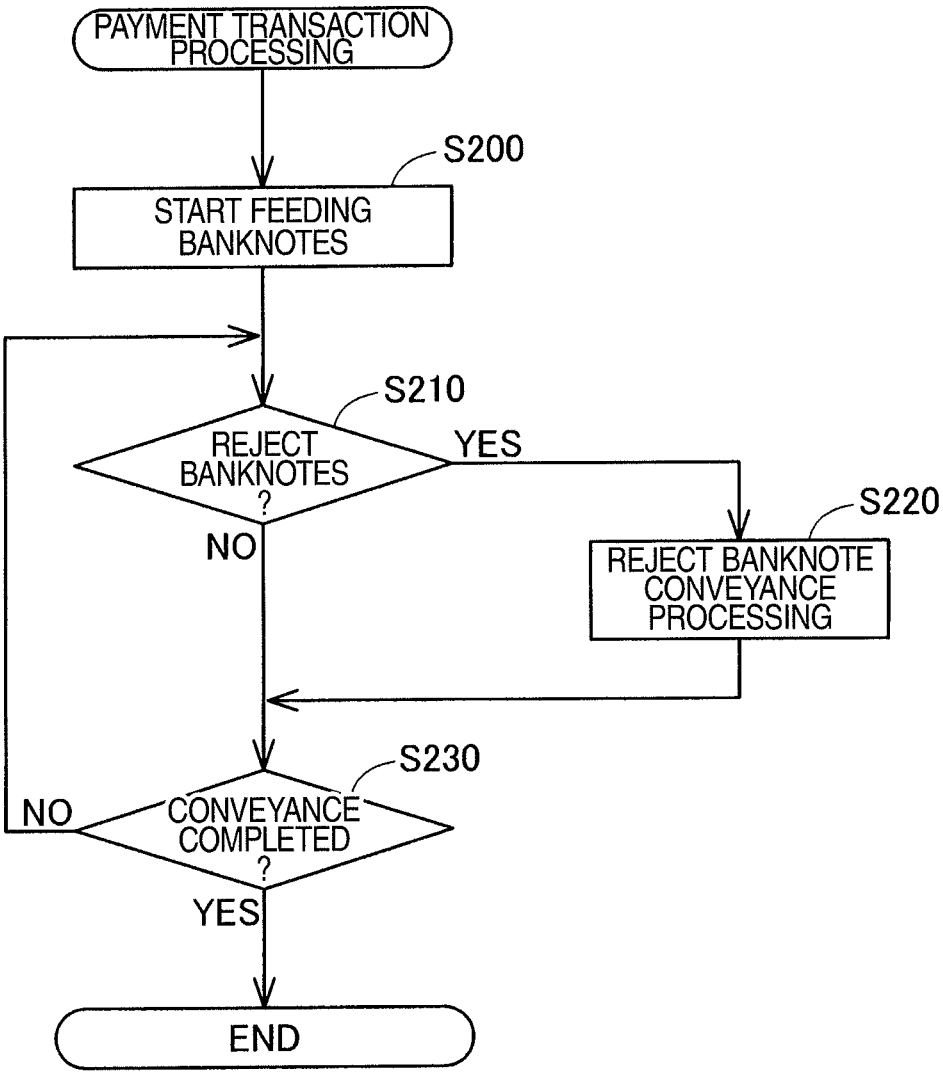
FIG. 10 An explanatory view showing a processing procedure of payment transaction processing.

[2] Payment Transaction Processing:

FIG. 10 is a flow chart showing a processing procedure for payment transaction processing performed by the banknote handling device 100. Here, the "payment transaction processing" is processing to take out banknotes for an amount responding to the demand or the like from the customer from the first to fourth banknote storage compartments 71 to 74 of the banknote handling device 100. Similar to the deposit transaction processing, the payment transaction processing excludes the reject banknotes detected during conveyance from an object for transaction.

In step S200, the main control unit 161 configures a conveyance route for payment transaction processing in the processing mechanism 101. And, the main control unit 161 feeds the necessary banknotes one by one from the first to fourth banknote storage compartments 71 to 74 and starts conveyance of banknotes.

Figure 11:
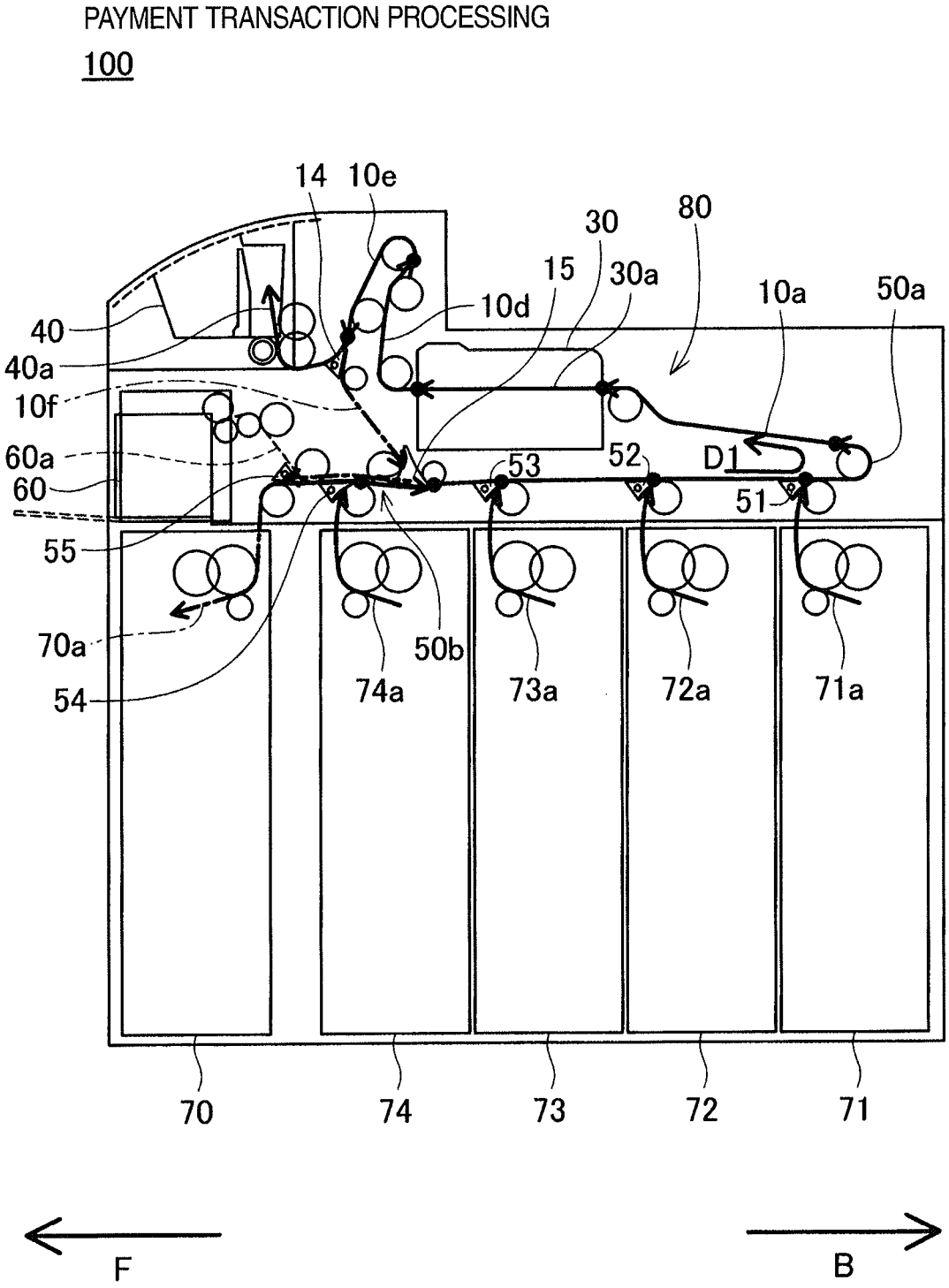
FIG. 11 A schematic view showing banknote conveyance routes in payment transaction processing.

FIG. 11 is a schematic view showing conveyance routes for banknotes in payment transaction processing. FIG. 11 is almost the same as FIG. 8 excepting the point that the reject banknote conveyance route is indicated by a dot-and-dash line. FIG. 11 shows for convenience the conveyance path 50*b* by solid arrows when it is functioning as a normal banknote conveyance path, and by a dot-and-dash arrow when it is functioning as a reject banknote conveyance path.

In payment transaction processing, the banknotes fed from the respective banknote storage compartments 71 to 74 are conveyed to the banknote depositing/dispensing port 40 through a route similar to the return banknote conveyance route involved in the above-described deposit transaction processing. However, in the payment transaction processing, the banknote determination unit 30 performs discrimination processing to determine whether the banknotes are reject banknotes or not (step S210 in FIG. 10).

If a reject banknote is detected, the main control unit 161 switches the structure of the conveyance path 80 as described below to convey the reject banknote to the payment reject compartment 70 (step S220). The main control unit 161 temporarily stops feeding banknotes from the fourth banknote storage compartment 74. At this time, feeding of banknotes from the first to third banknote storage compartments 71 to 73, and conveyance of banknotes through the conveyance paths 50*a* and 10*a* are in a continued state.

When it is detected that no banknote in conveyance is on the conveyance path 50*b*, the main control unit 161 reverses the conveying direction of the conveyance path 50*b* and also drives the connecting conveyance path 70*a* of the payment reject compartment 70 (conveyance route indicated by a dot-and-dash line in FIG. 11). In addition, the main control unit 161 controls the gate 14 to release the connection between the conveyance path 10*e* and the conveyance path 40*a* and to connect the conveyance path 10*e* and the conveyance path 10*f*, and also controls the gate 15 to connect the conveyance path 10*f* and the conveyance path 50*b*.

The reject banknote in the conveyance path 10*e* is conveyed to the conveyance path 50*b* through the conveyance path 10*f* and conveyed to the payment reject compartment 70 by the conveyance path 50*b* and the connecting conveyance path 70*a*. When storing of the reject banknote into the payment reject compartment 70 is completed, the main control unit 161 restores again the structure of the banknote conveyance route which is from the respective banknote storage compartments 71 to 74 to the banknote depositing/dispensing port 40.

By the way, in the banknote handling device 100 of this example, the reject banknote discrimination processing by the banknote determination unit 30 is completed while the banknotes which are discrimination objects are passing through the conveyance path 10*d* which is at the front side of the banknote determination unit 30. Thus, the banknotes which are discrimination objects can be smoothly conveyed to the conveyance path 10*f* connected to the conveyance path 40*a* of the banknote depositing/dispensing port 40 or the payment reject compartment 70 smoothly according to the discrimination results. That is, the conveyance path 10*d* functions as a path for securing a time until the discrimination results are obtained on the reject banknotes.

In the payment transaction processing, the reject banknotes may be conveyed to the deposit reject compartment 60 instead of the payment reject compartment 70. In this case, the main control unit 161 drives the conveyance path 60*a* for reject compartment of the deposit reject compartment 60 and also controls the gate 55 to connect the conveyance path 60*a* for reject compartment and the conveyance path 50*b*.

The main control unit 161 continues the above-described conveyance of banknotes until banknotes for a necessary amount are stored into the banknote depositing/dispensing port 40 (step S230 in FIG. 10), and opens the shutter of the banknote depositing/dispensing port 40 when the conveyance of banknotes is completed. Thus, the user can take out the bundle of banknotes from the banknote depositing/dispensing port 40 and can give to the customer.

Thus, the banknote handling device 100 of this example can perform payment transaction processing efficiently to perform payment of reject banknotes while excluding from the transaction object quickly through the banknote conveyance route having a simple structure. And, banknote protection properties in payment transaction processing are improved because the banknote conveyance route is shortened and simplified.

Figure 12:
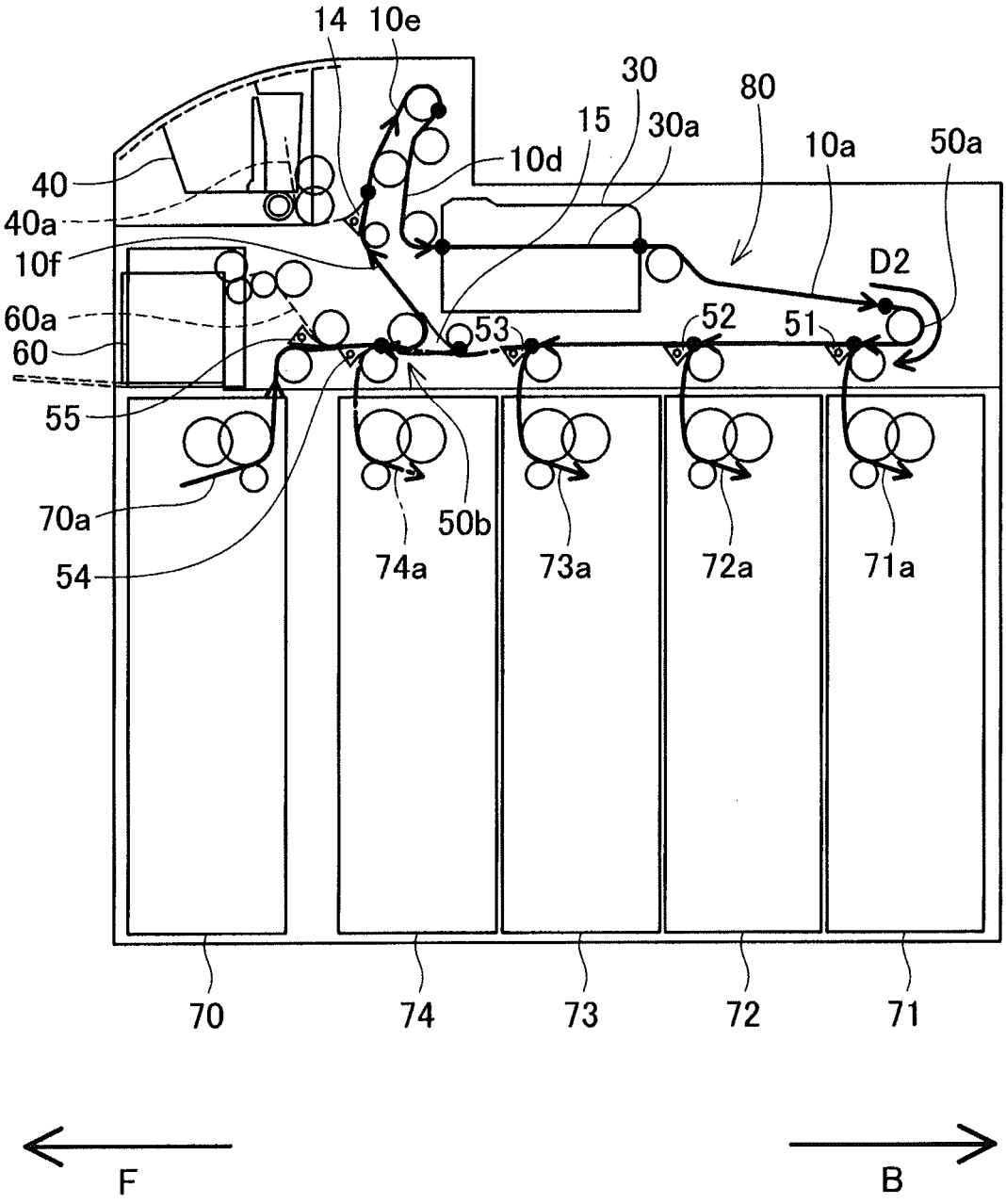
FIG. 12 A schematic view showing banknote conveyance routes in banknote loading processing.

[3] Banknote Loading Processing:

FIG. 12 is a schematic view similar to FIG. 11, showing banknote conveyance routes in the banknote loading processing performed by the banknote handling device 100. Here, "banknote loading processing" means processing to load (replenish) previously banknotes into the first to third banknote storage compartments 71 to 73 before performing the above-described transaction processing with the customer in the banknote handling device 100.

Meanwhile, in this banknote loading processing, the storage compartment, which functioned as the payment reject compartment 70 in the above-described transaction processing, functions as a storage compartment in which a bundle of banknotes to be loaded is stored. And, the storage compartment which functioned as the fourth banknote storage compartment 74 functions as a storage compartment for storing the reject banknotes. In the following, the payment reject compartment 70 is also called "loaded banknote storage compartment 70", and the fourth banknote storage compartment 74 also called "reject compartment 74."

At the time of performing the banknote loading processing, the main control unit 161 controls the gate 55, the connecting conveyance path 70*a* of the loaded banknote storage compartment 70 and the conveyance path 50*b* are connected. And, the gate 15 is controlled to connect the conveyance path 50*b* and the conveyance path 10*f*, and the gate 14 is controlled to connect the conveyance path 10*f* and the conveyance path 10*e*.

Furthermore, the main control unit 161 controls the rotation direction of the first drive motor 10*m* so that the banknote conveying direction of the first conveyance path 10 becomes a direction of arrow D2. And, the main control unit 161 controls the rotation direction of the second drive motor 20*m* so that the banknote conveying direction of the second conveyance path 20 becomes a direction from the front side to the back side. Thus, the banknote handling device 100 constitutes a conveyance route that banknotes can reach any of the first to third banknote storage compartments 71 to 73 from the loaded banknote storage compartment 70 via the banknote determination unit 30.

The main control unit 161 feeds banknotes one by one from the loaded banknote storage compartment 70 through the connecting conveyance path 70*a*. The fed banknotes are conveyed to the banknote determination unit 30 through the conveyance paths 50*b*, 10*f*, 10*e* and 10*d*. In the banknote determination unit 30, denomination discrimination of banknotes, reading of serial numbers, and detection of reject banknotes are performed.

The main control unit 161 receives information about the banknotes obtained by the banknote determination unit 30, controls the gates 51 to 53, and loads the banknotes having passed through the conveyance paths 10*a* and 50*a* to any of the first to third banknote storage compartments 71 to 73 according to denomination. And, the main control unit 161 stores into the memory 162 and also transmits to the operation terminal 200 information about banknotes to be loaded with the serial numbers corresponded with the storage destinations according to the information about the banknotes obtained from the banknote determination unit 30.

Thus, the banknote handling device 100 of this example can record storage destinations of individual banknotes and the number of stored banknotes of each denomination at the time of banknote loading processing, and can improve banknote manageability of the banknote handling device 100. Meanwhile, the operation terminal 200 may create a database in which storage destinations of respective banknotes can be retrieved on the basis of record data. And, the operation terminal 200 may generate a list of serial numbers of the stored banknotes for the individual banknote storage compartments 71 to 73 to provide to the user.

Here, if a reject banknote is detected in the banknote determination unit 30, the main control unit 161 switches the banknote conveyance route as follows. The main control unit 161 stops the drive of the connecting conveyance path 70*a* and temporarily stops feeding of the banknotes from the loaded banknote storage compartment 70. And, the conveying direction of the conveyance path 50*b* is reversed, and the drive of the connecting conveyance path 74*a* in the reject compartment 74 is started.

Thus, the reject banknote is caused to pass through the inlet ports of the first to third banknote storage compartments 71 to 73 and can be stored into the reject compartment 74 through the conveyance paths 50*b* and 74*a*. When storing of the reject banknote is completed, the main control unit 161 restores the banknote conveyance route which is from the loaded banknote storage compartment 70 to the first to third banknote storage compartments 71 to 73.

Also, in the banknote loading processing, the reject banknote may be conveyed to the deposit reject compartment 60 instead of the reject compartment 74. In this case, the main control unit 161 may control the gate 55 to connect the conveyance path 50*b* not to the connecting conveyance path 74*a* in the reject compartment 74 but to the conveyance path 60*a* for reject compartment in the deposit reject compartment 60.

As described above, the banknote handling device 100 of this example can load banknotes into the first to third banknote storage compartments 71 to 73 by banknote loading processing simply and efficiently while removing reject banknotes. And, since the serial numbers of the banknotes to be loaded into the first to third banknote storage compartments 71 to 73 can be recorded, banknote manageability of the banknote handling device 100 can be improved.

Figure 13:
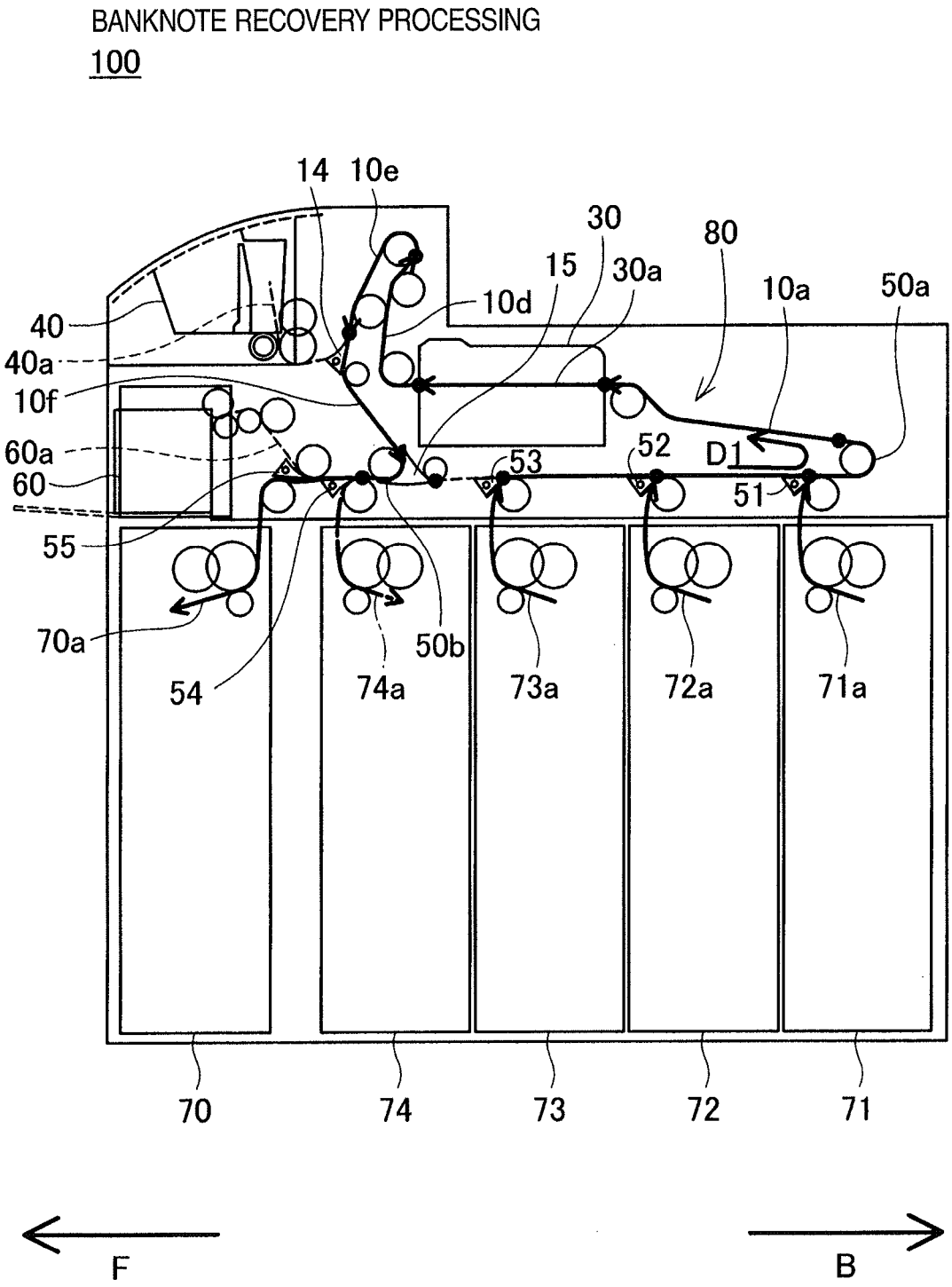
FIG. 13 A schematic view showing banknote conveyance routes in banknote recovery processing.

[4] Banknote Recovery Processing:

FIG. 13 is a schematic view similar to FIG. 12, showing banknote conveyance routes involved in banknote recovery processing performed by the banknote handling device 100. Here, the "banknote recovery processing" means processing for recovery into the loaded banknote storage compartment 70 the banknotes accumulated in the first to third banknote storage compartments 71 to 73 after performing the transaction processing by the banknote handling device 100. Also, in the following description of the banknote recovery processing, two storage compartments 70 and 74 are called "loaded banknote storage compartment 70" and "reject compartment 74" similar to the above-described description of the banknote loading processing.

At the time of performing the banknote recovery processing, the main control unit 161 controls the gates 14, 15 and 55, the connecting conveyance path 70*a* of the loaded banknote storage compartment 70, the conveyance path 50*b*, the conveyance path 10*f* and the conveyance path 10*e* are connected similar to the above-described banknote loading processing. And, the main control unit 161 controls the rotation direction of the first drive motor 10*m* so that the banknote conveying direction in the first conveyance path 10 becomes a direction of arrow D1.

And, the main control unit 161 controls the rotation direction of the second drive motor 20*m* so that the banknote conveying direction in the second conveyance path 20 becomes a direction from the back side to the front side. Thus, a conveyance route is constituted so that the banknotes fed from the first to third banknote storage compartments 71 to 73 can reach the loaded banknote storage compartment 70 via the banknote determination unit 30.

The main control unit 161 feeds in a prescribed order banknotes one by one from any of the first to third banknote storage compartments 71 to 73 through the corresponding connecting conveyance paths 71*a* to 73*a*. The fed banknotes are conveyed to the banknote determination unit 30 through the conveyance paths 50*a* and 10*a*. The banknote determination unit 30 performs discrimination of denomination of banknotes, reading of serial numbers, and detection of reject banknotes. Information related to the banknotes obtained by the banknote determination unit 30 is transmitted to the main control unit 161.

The banknotes having passed through the banknote determination unit 30 are stored in the loaded banknote storage compartment 70 through the conveyance paths 10*d*, 10*e*, 10*f*, 50*b* and 70*a*. The main control unit 161 stores information bout the banknotes obtained from the banknote determination unit 30 into the memory 162 and also transmits to the operation terminal 200. Thus, about the banknotes recovered, the number of banknotes of each denomination and serial numbers can be obtained, and banknote manageability of the banknote handling device 100 can be improved. Meanwhile, the operation terminal 200 may be determined to generate a list and database of the recovered banknotes according to the received information about the banknotes.

Here, if a reject banknote is detected by the banknote determination unit 30, the main control unit 161 temporarily switches the constitution of the conveyance path 80 as follows. The main control unit 161 stops the drive of the connecting conveyance path 70*a* in the loaded banknote storage compartment 70 and also starts driving the connecting conveyance path 74*a* in the reject compartment 74. And, the gate 54 is controlled to connect the conveyance path 50*b* and the connecting conveyance path 74*a*.

Thus, the reject banknote can be stored in the reject compartment 74. When storing of the reject banknote is completed, the main control unit 161 restores the banknote conveyance route which is from the first to third banknote storage compartments 71 to 73 to the loaded banknote storage compartment 70. Meanwhile, in the banknote recovery processing, the reject banknote may be conveyed to the deposit reject compartment 60 instead of the reject compartment 74.

As described above, the banknote handling device 100 of this example can recover banknotes from the first to third banknote storage compartments 71 to 73 by banknote recovery processing simply and efficiently while removing reject banknotes. And, since the number of recovered banknotes of each denomination and serial numbers can be recorded, banknote manageability can be improved.

Figure 14:
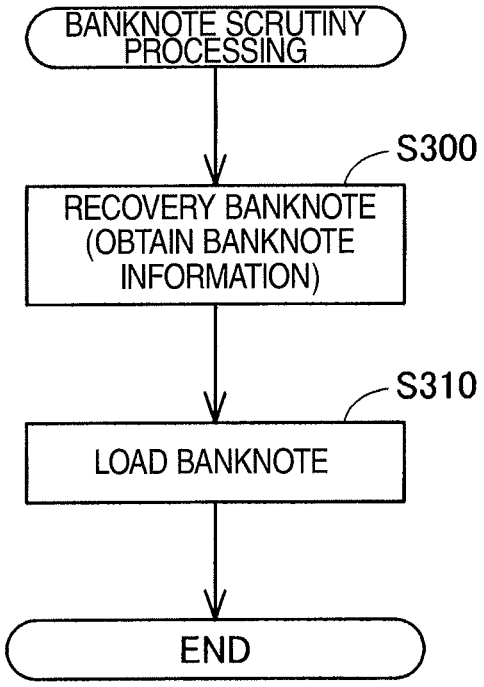
FIG. 14 An explanatory view showing a processing procedure of banknote scrutiny processing.

[5] Banknote Scrutiny Processing:

FIG. 14 is a flow chart showing a processing procedure of banknote scrutiny processing performed by the banknote handling device 100. Here, the "banknote scrutiny processing" means processing for scrutinizing the number of banknotes of each denomination and serial numbers of the banknotes stored in the first to third banknote storage compartments 71 to 73 before and after performing the transaction processing by the banknote handling device 100. Meanwhile, in the following description of the banknote scrutiny processing, similar to the above-described description of the banknote recovery processing, two storage compartments 70 and 74 are called "loaded banknote storage compartment 70" and "reject compartment 74."

In step S300, the main control unit 161 recovers the banknotes in the first to third banknote storage compartments 71 to 73 into the loaded banknote storage compartment 70 by the same procedure and conveyance route as in the above-described banknote recovery processing (FIG. 13). Meanwhile, at this time, the main control unit 161 obtains denominations and serial numbers of banknotes by the banknote determination unit 30, stores them together with information for specifying the storage compartments in which the banknotes were stored into the memory 162, and transmits to the operation terminal 200. At the time of the banknote recovery processing, the reject banknotes detected by the banknote determination unit 30 are stored into the reject compartment 74.

In step S310, the main control unit 161 loads the banknotes of the loaded banknote storage compartment 70 into the original banknote loading compartments 71 to 73 by the same procedure and conveyance route as the above-described banknote loading processing (FIG. 12). In this step, the reject banknote detected by the banknote determination unit 30 is also stored in the reject compartment 74. In this step, the banknote determination unit 30 performs only discrimination of the reject banknote and may omit discrimination processing of denomination of banknotes and reading processing of serial numbers.

As described above, the banknote handling device 100 of this example can check the number and serial numbers of the banknotes stored in the first to third banknote storage compartments 71 to 73 while simply and efficiently removing reject banknotes by banknote scrutiny processing. Therefore, banknote manageability by the banknote handling device 100 can be improved.

[MODIFICATIONS]

The present invention is not limited to the above-described examples or embodiments and can be performed by various modes without departing from the scope of the present invention. For example, examples and embodiments of the present invention may not be provided with all the structures described in the above-described examples and embodiments, and it is also possible to omit the structures partly or to substitute them with other structures. And, other structures may also be added to the structures of the examples and embodiments described above.

In addition, all or part of the respective configuration sections, functions, processing sections, processing means, etc. of the above-described examples and embodiments may be realized by hardware such as an integrated circuit or may be realized by software such as a computer program performed by a processor or the like, in a form of a recording medium which records information such as software such as the pertinent computer program, database, tables, and files for practicing the present invention.

And, the present invention can be realized in various modes other than the above-described examples and embodiments and can be realized as, for example, a banknote handling device, a banknote management method in the banknote handling device, a conveyance method, and a control method and control device of the banknote handling device.

[1] Modification 1:

In the above-described examples, the banknote handling device 100 was provided with four banknote storage compartments 71 to 74. However, the banknote handling device 100 may be provided with more banknote storage compartments or may be provided with less than four banknote storage compartments. The number of banknote storage compartments in the banknote handling device 100 can be arbitrarily determined depending on the kinds of handled banknotes. And, in the banknote handling device 100, the conveyance path 80 may have a structure other than the structure described in the above-described examples.

[2] Modification 2:

In the above-described examples, the banknote handling device 100 performed the deposit transaction processing and the payment transaction processing. And, as the preparation processing for transaction, the banknote loading processing, banknote recovery processing and banknote scrutiny processing were performed. However, the banknote handling device 100 may further perform other transaction processing and other preparation processing. And, among the above processing, it is appropriate when at least the banknote loading processing is performed, and other processing need not be performed.

[3] Modification 3:

In the above-described examples, the banknote determination unit 30 performed discrimination processing of denomination of banknotes, reading processing of serial numbers of banknotes, and detection processing of reject banknotes. However, it is sufficient that the banknote determination unit 30 performs at least the reading processing of serial numbers of banknotes. Meanwhile, if the banknote determination unit 30 does not perform the discrimination processing of denomination, the banknote handling device 100 may have, for example, banknotes loaded into the respective banknote storage compartments 71 to 73 in a prescribed order.

[4] Modification 4:

In the deposit transaction processing of the above-described examples, the banknote determination unit 30 did not perform detection of reject banknotes at the time of conveyance of return banknotes. However, the banknote determination unit 30 may also detect reject banknotes in the return banknotes. Meanwhile, in this case, the detected reject banknotes may be conveyed to the deposit reject compartment 60 or the payment reject compartment 70 through the same path as in the payment transaction processing.

[5] Modification 5:

In the above-described examples, the banknote handling device 100 had a structure not provided with a temporary holding compartment. However, the banknote handling device 100 may be provided with a temporary holding compartment. However, the banknote conveyance route can be shortened and simplified because the temporary holding compartment is omitted. And, the respective transaction processing and preparation processing can be performed efficiently, and the device can be miniaturized.

[6] Modification 6:

In the above-described examples, the record data obtained by the banknote determination unit 30 was stored into the memory 162 and also transmitted to the operation terminal 200. However, the transmission of record data to the operation terminal 200 may be omitted.

REFERENCE SIGNS LIST

10: First conveyance path
10*a*, 10*d*, 10*e*, 10*f*, 50*a*, 50*b*: Conveyance path
10*m*: First drive motor
14, 15: Gate
16: Control unit
161: Main control unit
1611: Deposit transaction processing executing part
1612: Payment transaction processing executing part
1613: Banknote loading processing executing part
1614: Banknote recovery processing executing part
1615: Banknote scrutiny processing executing part
162: Memory
163: High order communication unit
165: Detection sensor
166: Drive motor
167: Gate
20: Second conveyance path
20*m*: Second drive motor
30: Banknote determination unit
30*a*: Conveyance path
40: Banknote depositing/dispensing port
40*a*: Deposing/dispensing conveyance path
51-55: Gate
60: Deposit reject compartment
60*a*: Conveyance path for reject compartment
70: Payment reject compartment/loaded banknote storage compartment
70*a*: Connecting conveyance path
71-73: First to third banknote storage compartments
74: Fourth banknote storage compartment/reject compartment
71*a*-74*a*: Connecting conveyance path
80: Conveyance path
100: Banknote handling device
101: Processing mechanism
102: Housing mechanism
200: Operation terminal
201, 202: Staff communication

The invention claimed is:

1. A banknote handling device, comprising:

multiple banknote storage compartments in which banknotes are stored;

a banknote loading compartment in which stored are banknotes to be loaded into each of the multiple banknote storage compartments;

a banknote determination unit which obtains serial numbers from banknotes in conveyance between the multiple banknote storage compartments and the banknote loading compartment;

banknote conveyance paths which connect the banknote loading compartment, the banknote determination unit, and the multiple banknote storage compartments; and a control unit for performing banknote loading processing to make the banknote determination unit obtain the serial numbers of the banknotes while loading the banknotes from the banknote loading compartment to each of the multiple banknote storage compartments by controlling the conveyance path to convey the banknotes in a first conveying direction from the banknote loading compartment to each of the multiple banknote storage compartments via the banknote determination unit;

wherein:

the control unit controls the conveyance path to convey banknotes in a second conveying direction toward the banknote loading compartment from the multiple banknote storage compartments via the banknote determination unit, and performs banknote recovery processing to make the banknote determination unit obtain the serial numbers of the banknotes while recovering the banknotes from each of the multiple banknote storage compartments to the banknote loading compartment;

the banknote handling device, further comprising:

a reject banknote storage compartment for storing reject banknotes which are banknotes not satisfying a prescribed standard, wherein:

the banknote determination unit has a function to detect the reject banknotes in the banknotes in conveyance, the conveyance path has a switching mechanism for switching a conveyance destination of the banknotes being conveyed in the first or second conveying direction to the reject banknote storage compartment, and the control unit, if the reject banknotes are detected by the banknote determination unit, conveys the reject banknotes to the reject banknote storage compartment via the switching mechanism;

wherein:

the reject banknote storage compartment is arranged next to the banknote loading compartment;

the conveyance path includes:

a first conveyance path which is formed to have a loop shape and connects the banknote determination unit and the individual inlet ports of the multiple banknote storage compartments, and a second conveyance path which is respectively connected to the first conveyance path, an inlet port of the reject banknote storage compartment, and an inlet port of the banknote loading compartment;

the switching mechanism includes:

a first gate part which controls conveyance of banknotes between the first conveyance path and the second conveyance path, and a second gate part which switches the banknote conveyance destination to the banknote loading compartment or the reject banknote storage compartment by the second conveyance path; and the control unit:

(i) when the banknote loading processing is performed, conveys the banknotes fed from the banknote loading compartment to the second conveyance path to the first conveyance path via the first gate part, to store into each of the multiple banknote storage compartments via the banknote determination unit, passes the reject banknotes detected by the banknote determination unit through the inlet ports of the multiple banknote storage compartments, and returns from the first conveyance path to the second conveyance path via the first gate part to convey to the reject banknote storage compartment via the second gate part, and (ii) when the banknote recovery processing is performed, conveys the banknotes, which were fed from each of the multiple banknote storage compartments to the first conveyance path, to the second conveyance path through the first gate part via the banknote determination unit, and conveys to the banknote loading compartment through the second gate part, and conveys the reject banknotes detected by the banknote determination unit to the second conveyance path through the first gate part, and conveys to the reject banknote storage compartment through the second gate part.

2. The banknote handling device according to claim 1, wherein:

the banknote determination unit further has a function to discriminate the denomination of banknotes in conveyance, and the control unit performs banknote scrutiny processing by conveying banknotes in the first conveying direction through the conveyance path to recover the banknotes from each of the multiple banknote storage compartments into the banknote loading compartment, switching the banknote conveying direction to the second conveying direction to return the banknotes recovered into the banknote loading compartment to each of the multiple banknote storage compartments, and obtaining the serial numbers of the banknotes stored in the multiple banknote storage compartments and the number of banknotes of each denomination while the banknotes are moving back and forth between the multiple banknote storage compartments and the banknote loading compartment.

3. The banknote handling device according to claim 2, further comprising:

a banknote receiving port for receiving the banknotes from a customer, wherein:

the conveyance path has a deposit conveyance path for connecting the banknote receiving port and the banknote determination unit;

the control unit performs:

deposited banknote storing processing that feeds banknotes from the banknote receiving port into the deposit conveyance path, and stores the banknotes into each of the multiple banknote storage compartments while obtaining the serial numbers of the banknotes by the banknote determination unit, and deposited banknote return processing that feeds the banknotes, which were stored into each of the multiple banknote storage compartments by the deposit storing processing, from each of the multiple banknote storage compartments into the conveyance path, and returns to the banknote receiving port via the banknote determination unit; and the control unit obtains by the banknote determination unit the serial numbers of the banknotes to be returned when the deposited banknote return processing is performed, and collates with the serial numbers recorded when the deposited banknote storing processing was performed to detect a mismatch of them.

4. The banknote handling device according to claim 3, wherein:

a temporary storing compartment for temporarily storing accumulated banknotes is not provided between the banknote receiving port and the multiple banknote storage compartments.

5. The banknote handling device according to claim 1, further comprising:

a banknote receiving port for receiving the banknotes from a customer, wherein:

the conveyance path has a deposit conveyance path for connecting the banknote receiving port and the banknote determination unit;

the control unit performs:

deposited banknote storing processing that feeds banknotes from the banknote receiving port into the deposit conveyance path, and stores the banknotes into each of the multiple banknote storage compartments while obtaining the serial numbers of the banknotes by the banknote determination unit, and deposited banknote return processing that feeds the banknotes, which were stored into each of the multiple banknote storage compartments by the deposit storing processing, from each of the multiple banknote storage compartments into the conveyance path, and returns to the banknote receiving port via the banknote determination unit; and the control unit obtains by the banknote determination unit the serial numbers of the banknotes to be returned when the deposited banknote return processing is performed, and collates with the serial numbers recorded when the deposited banknote storing processing was performed to detect a mismatch of them.

6. The banknote handling device according to claim 5, wherein:

a temporary storing compartment for temporarily storing accumulated banknotes is not provided between the banknote receiving port and the multiple banknote storage compartments.

* * * * *